United States Patent [19]

Rowles et al.

[11] Patent Number: 4,852,945

[45] Date of Patent: Aug. 1, 1989

[54] COMPREHENSIVE CONTOUR CHAIR APPARATUS

[76] Inventors: John W. Rowles; Carl M. Arko, both of 4426 Appian Way, El Sobrante, Calif. 94803

[21] Appl. No.: 86,592

[22] Filed: Aug. 18, 1987

Related U.S. Application Data

[63] Continuation-in-part of Ser. No. 855,312, Apr. 24, 1986, abandoned.

[51] Int. Cl.[4] ..... A47C 7/02

[52] U.S. Cl. ..... 297/458; 297/DIG. 1; 297/DIG. 2

[58] Field of Search ..... 297/DIG. 1, DIG. 2, 297/458, 460, 458

[56] References Cited

U.S. PATENT DOCUMENTS

| | | | |
|---|---|---|---|
| 2,847,061 | 8/1958 | Morton | 297/457 |
| 3,740,096 | 6/1973 | Bridger | 297/459 |
| 4,418,958 | 12/1983 | Watkin | 297/458 |
| 4,577,907 | 3/1986 | Talmon | 297/DIG. 1 |

FOREIGN PATENT DOCUMENTS

| | | | |
|---|---|---|---|
| 2844628 | 4/1980 | Fed. Rep. of Germany | 297/DIG. 8 |

*Primary Examiner*—James T. McCall
*Attorney, Agent, or Firm*—Harry A. Pacini

[57] ABSTRACT

A human seating apparatus comprehensively designed to provide prolonged body support from contoured specifications; constructed of rigid shaped one piece seating receptacle made of thermo formable materials and providing for a method of making the receptacle by taking an impression of the seated individual in a pellet containing bladder, making corrective changes, preparing a positive mold impression and forming a first sheet of heat moldable plastic over said positive mold and forming a second sheet of heat moldable rigid plastic over the first sheet, adhesively binding the two molded sheets together to form the seating receptacle, affixing the receptacle to a mounting ring and then to a chair stand base support.

11 Claims, 14 Drawing Sheets

COMPREHENSIVE CONTOUR CHAIR APPARATUS

This application is a continuation-in-part application of application Ser. No. 855312 filed, Apr. 24, 1986 now abandoned.

FIELD OF THE INVENTION

This invention relates to seating chairs in general, and more particularly to a chair which provides comprehensive prolonged positive body support in favorable torso receptor areas thus providing proper prolonged body posture. The invention also provides improvements to chairs in general by providing a chair which allows negative relief in torso areas which will benefit from sustained relief, thus providing non impinged or even added blood circulation to areas which are salutary to the body.

BACKGROUND OF THE INVENTION

There are untold types of seating chairs in existance today. Most of them, for one reason or another, do not provide enough of the essential elements needed within a chair to easily hold proper torso angulation and provide long term proper spinal support and positioning. Nor do these chairs allow for the proper relief for certain body areas which would benefit by such relief. Nor do these chairs aid in maintaining or promoting proper body position for prolonged periods of time thereby preventing spinal distortion or possible spinal deformation or pathogenesis. Nor do these chairs give enough body support in the proper weight bearing areas. Nor do these chairs provide comprehensive back support when the seated subject moves about within his seated position for purposes necessary to his daily occupation.

With the use of modern materials and techniques, and also careful analysis of postural needs of the torso for various sitting occupations, these elements can now be incorporated into a type of chair, or similiarily related types of chairs.

There have been endeavors within the handicap and disability health fields to develop custom molding methods and fabricate a chair with designs which will provide some of the above mentioned elements within said chair. For many years, in the field of orthotics, there have been endeavors to take impressions of pertinent human anatomical parts using thin flexible bags filled with small styrofoam pellets or chemically active resin particles. A coalescing force is applied to the beads within the bag using a central vacuum source. This constricts the beads together within the bag thereby keeping them in the shape of the form impressed upon the bag apparatus.

Specifically, various custom molding methods, or variations thereof, have been described in patents by Rogers Jr. in U.S. Pat. No. 4,347,213, Davis in U.S. Pat. No. 4,327,046 and Silverman, U.S. Pat. No. 4,615,856, whereby bags are filled with small pellets to impress an area of human anatomy and then coalesce the image by applying a vacuum to the bag. Rogers Jr. and Silverman form positive molds by applying wet plaster bandages to the impression and waiting for the set of the plaster. Davis uses an active resi system within the particle bag itself which actually solidifies to form the completed seating appliance.

Morton, U.S. Pat. No. 2,847,061, discloses the use of thin rubber cushions moderately inflated with air to allow a subject to sit in and thereby impress their image into the bag . This is done while the subject sits upon strips of meshed fabric coated with a setting material. The fabric impregnated with the setting material is displaced to the desired anatomical shape by the deformation within the impression bag. A positive mold was thereby obtained after the set of the material.

In other previous related technique, Webster, U.S. Pat. No. 3,662,057, uses sheets of moldable thermoplastic materials to directly mold around various human anatomical areas for formation of a splint or cast for healing of traumatized human anatomical parts.

OBJECTS AND ADVANTAGES

It is an object of this invention is to provide a comprehensive contour chair of general adaptability, not limited to handicapped or injured persons.

Another object of this invention is to provide a method whereby in a one step direct fabrication process a strong dense positive mold made of plaster or the like is formed. This mold which can be reused many times for fabrication of numerous chairs without additional reinforcement to said positive mold.

Another object of this invention is to utilize a molding technique relying upon moldable thermoplastics to directly mold a solid positive form as a one piece, or a layered chair shell.

Yet another object is to provide a comprehensive evaluation and placement of negative relief areas for individual requirements.

Another object is to provide a chair which resultantly will translate the tensing of the stomach muscles and placement of thrust on the weight bearing areas of the lower thighs of a seated individual, into a follow up back support function.

DESCRIPTION OF THE INVENTION

The current invention applies to chairs in general and does not limit its techniques specifically to the handicapped or injured population.

The current invention differs from previous methods by a one step direct fabrication of a strong dense positive mold made of plaster, which can be reused many times for fabrication of numerious chairs without additional reinforcement to said positive mold.

The current invention utilizes a molding technique relying upon moldable thermoplastics to mold directly to the above mentioned solid plaster positive for formation of a one piece, or a layered, moderately flexible, resilient chair shell. This teaches away from Webster, who uses the moldable modern plastic materials for a body cast or healing apparatus in the surgical and veterinary fields, and also as a wrapping, casing and packaging medium for objects. The current invention is directed to the area of preventive medicine and comprehensive body care and posture maintenance.

The current invention differs from previous art by comprehensively evaluating and placing necessary negative relief areas required of chairs for specific individuals, for specific seating situations, in specific occupations or endeavors, and if necessary, for specific individuals in such occupations or endeavors. It also takes into consideration the seating angle the subject finds himself while working or performing other endeavors. For example, for one application of the invention, the torso angulation of the body can be impressed at less than a 90 degree position at the waist for use for a practicing dentist who by nature of his occupation must lean foreward from a sitting position. When said dentist moves away from available back support the torso and spine are placed in a stressful and non supported position. This phenonomenon can be evidenced by any lay person who moves foreward in his chair thereby moving his back away from the chair back. In a short period of time the body exhibits a uncomfortable tense feeling within the lower back.

The invention utilizes the properties of thermoplastic plastics to fabricate a flexible chair shell which can be caused to move and apply thrust toward the back when desired by the seated subject by tensing his stomach muscles and placing thrust on the weight bearing areas of the lower thighs. This thrust is translated through the moderately flexible chair to provide the resilient following back support desired by the subject when he is seated in a stressful position.

The long term benefits of this principle can be testified to since such a chair has been in existence and in function since 1973. This chair has been used daily since then, and has successfully provided the subject dentist with positive back support and much less daily spinal fatigue.

If desired, further custom adaptation of the invention can easily be performed by adaptation and placement of a compressable foam rubber material located in the thoracic and lumbar spinal area. The location of this material can be easily moved up or down within the chair confines and the thickness can be altered to the subjects needs. The chair also incorporates a space relief area below the foam pad to provide large relief in the sacroiliac area which does not require direct positive support.

The slightly less than 90 degree angulation of the torso angulation of this particular chair of related types of chairs plays an important element in the effectiveness and functionality of this specific chair within the theam of this invention. This angulation serves a number of purposes: First, by nature of the angle of the seat, the mid-range of the under surface of the thighs and the ischeal tuberosities become the weight bearing areas. This in accordance with the relief provided in the rectal genital area not only allows circulation in the rectal genital area, but it also sets the body in position in the chair firmly to continuously provide for the natural alignment of the spine. This natural spine alignment can be further adjusted, if necessary by the physical placement and the modification of the thickness of the adjustable upper back foam cushion, and independantly by adjustment of the angulation with which chair shell is mounted to the supporting leg stand apparatus. These variables can be changed with facility depending upon initial specific fabrication goals.

By necessity, because of the amount of room made available within the confines of the chair the subject is required to maintain proper body alignment. By design of the chair, it is necessary to completely enter the body within its molded confines to feel comfortable. Once the subject assumes this position it becomes obvious that the body feels natural and supported while maintaining this sitting position.

As mentioned above, one of the main weight bearing areas is in the ischeal tuberosity area. This area becomes the functional pivot point about which the moderately flexable chair provides additional functions. In a firmly seated position, the subject notes that his posture is actually held in a straight foreward position. Furthermore, it may be noted that if the subject tightens his diaphramatic muscles, this places some tension upon the thighs, which is transformed into more upward back support. This provides two new innovations to chairs. First, it allows the subject to exercise diaphramatic muscles while sitting. Second, it allows the subject to regulate the amount of back support desired by placing tension on his thighs.

DESCRIPTION OF THE DRAWINGS

The features of the present invention, which are set forth with particularity in the appended claims. The invention may be further understood from the following detailed description of a preferred embodiment of this invention, taken in conjunction with the accompanying drawings, wherein:

Drawing Reference Numerals

Figure 1:
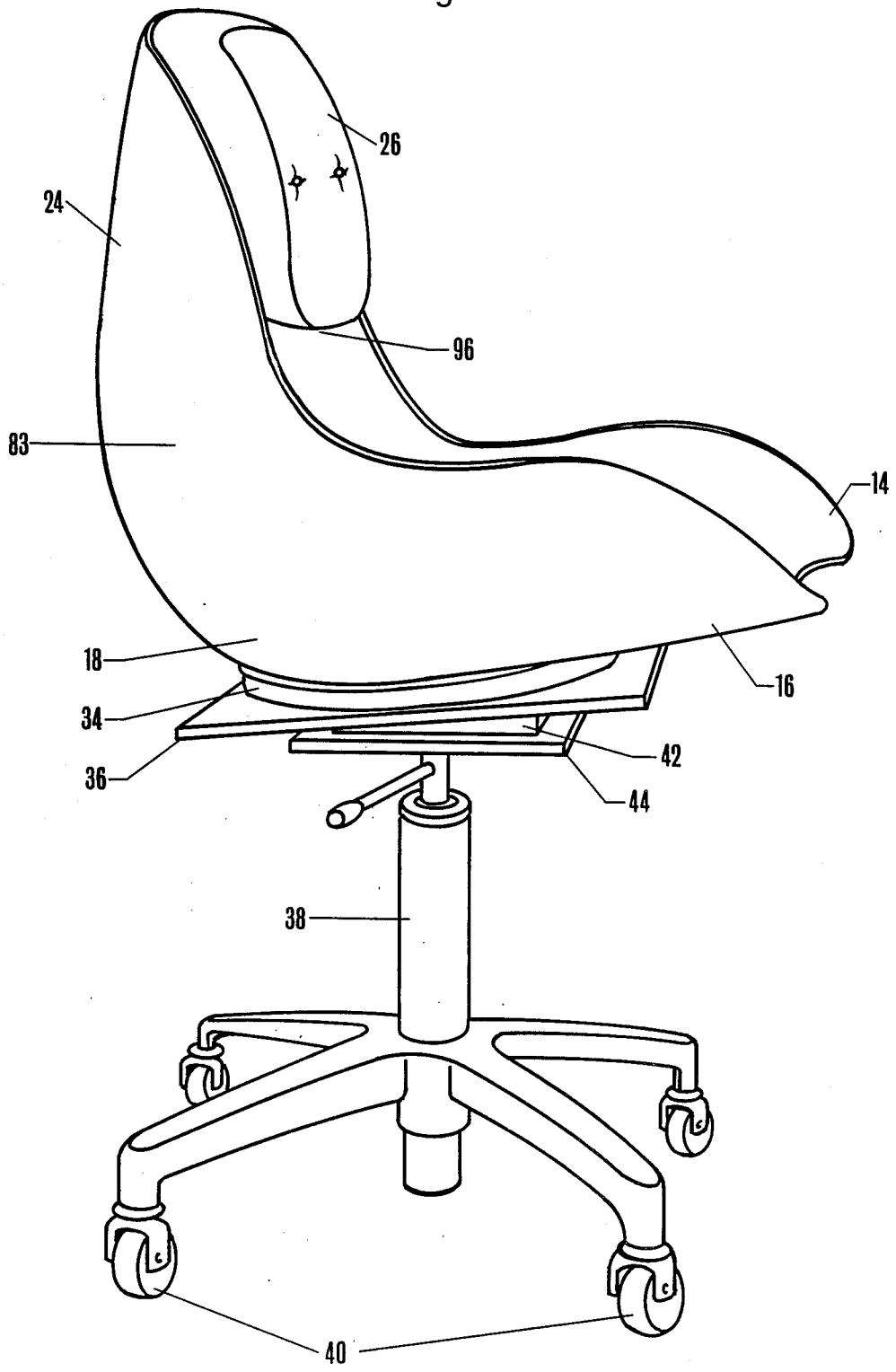
FIG. 1 is a side elevation of one type of chair within the realm of possible designs, which was constructed with the back to thigh body angulation impressed at less than 90 degrees. It illustrates the points of contact of the seated subject.

14 chair proper
16 thigh contact area
18 ischial tuberosity contact area
20 sacroiliac relief area
22 recto genital relief area
24 lumbo thoracic contact area
26 lumbo thoracic compression cushion
28 string ties
30 string tie holes
34 chair shell mounting ring
36 mounting ring base
38 adjustable chair stand
40 floor casters
42 chair mount wedge

44 adjustable chair stand base support
46 mould support bench
48 airtight flexible bladder
50 polystyrene pellets
52 bladder vacuum tube
54 bench back
56 back pivot
58 adjustable screw legs
60 subject
62 bench base
64 negative impression
65 plaster of paris
66 impression area
68 positive plaster mould
72 resilient moderately compressable liner (Pe-Lite)
73 vacuform adaptation apparatus
74 vacuum frame
76 airtight rubber bladder
78 frame stand
80 air from vacuum frame
82 vacuum line
84 vacuum pump
83 chair shell body
86 polypropylene
90 interleg cut away area
92 seat portion
94 thigh support flanges
96 back rest portion

DETAILED DESCRIPTION OF THE INVENTION

FIG. 1, is a side elevation which shows one embodiment of a comprehensive contour chair 14 within the description of the instant invention.

Figure 2:
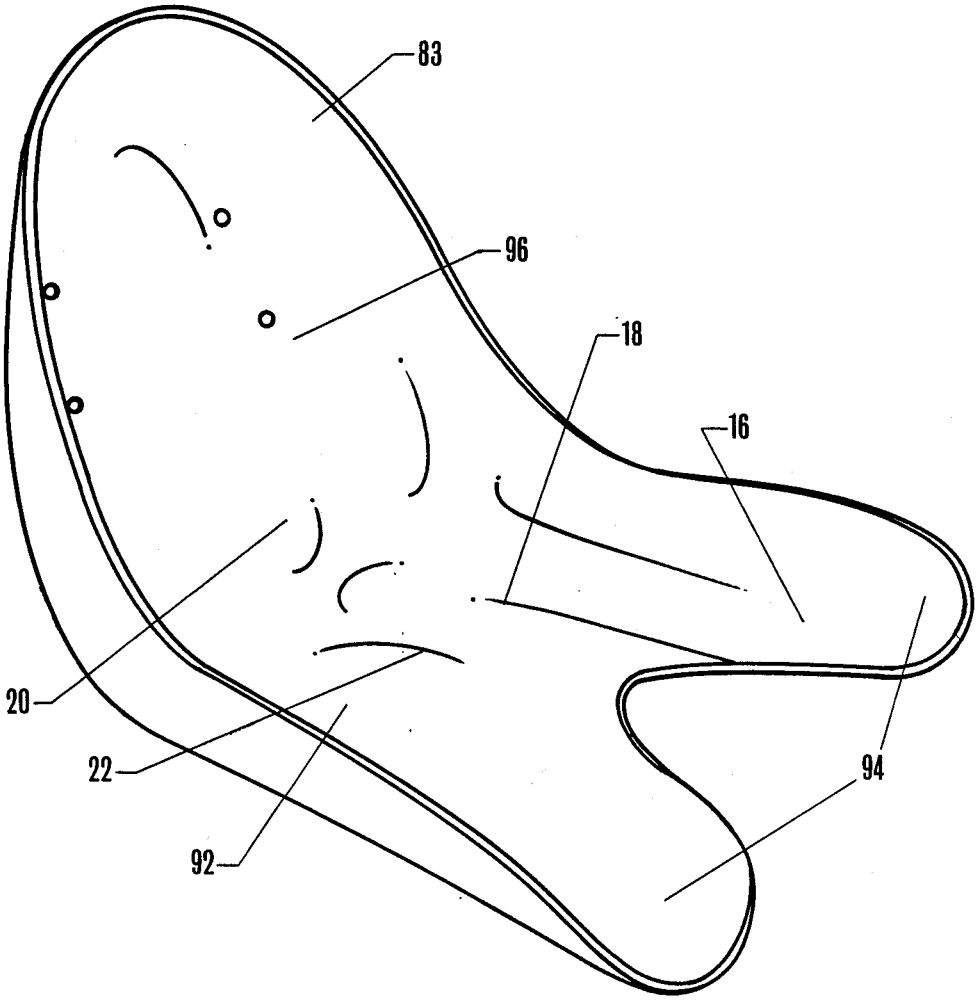
FIG. 2 is a perspective view of the chair shell looking down upon it at from a 45 degree angle.

The positive body contact areas within the contoured chair are as follows: It is noted that positive contact of the lower thighs is made in area 16 and another strong contact made in the ischial tuberosity area of the buttocks, area 18. FIG. 2, the perspective view from the top and front, also illustrates the lower thigh contact area 16 and the ischial tuberosity strong body support area 18. It should be noted that the chair attempts to gain as much lower thigh contact as possible since this area of the body can endure more prolonged pressures and stresses than other areas involved in seating.

FIG. 2 displays the sacroiliac 20, and recto genital 22, relief areas. Concave area 20, portrays the concavity for the subjects spine gained at the original impression taking. This can be modified for stress relief if necessary as will be described later.

Figure 3:
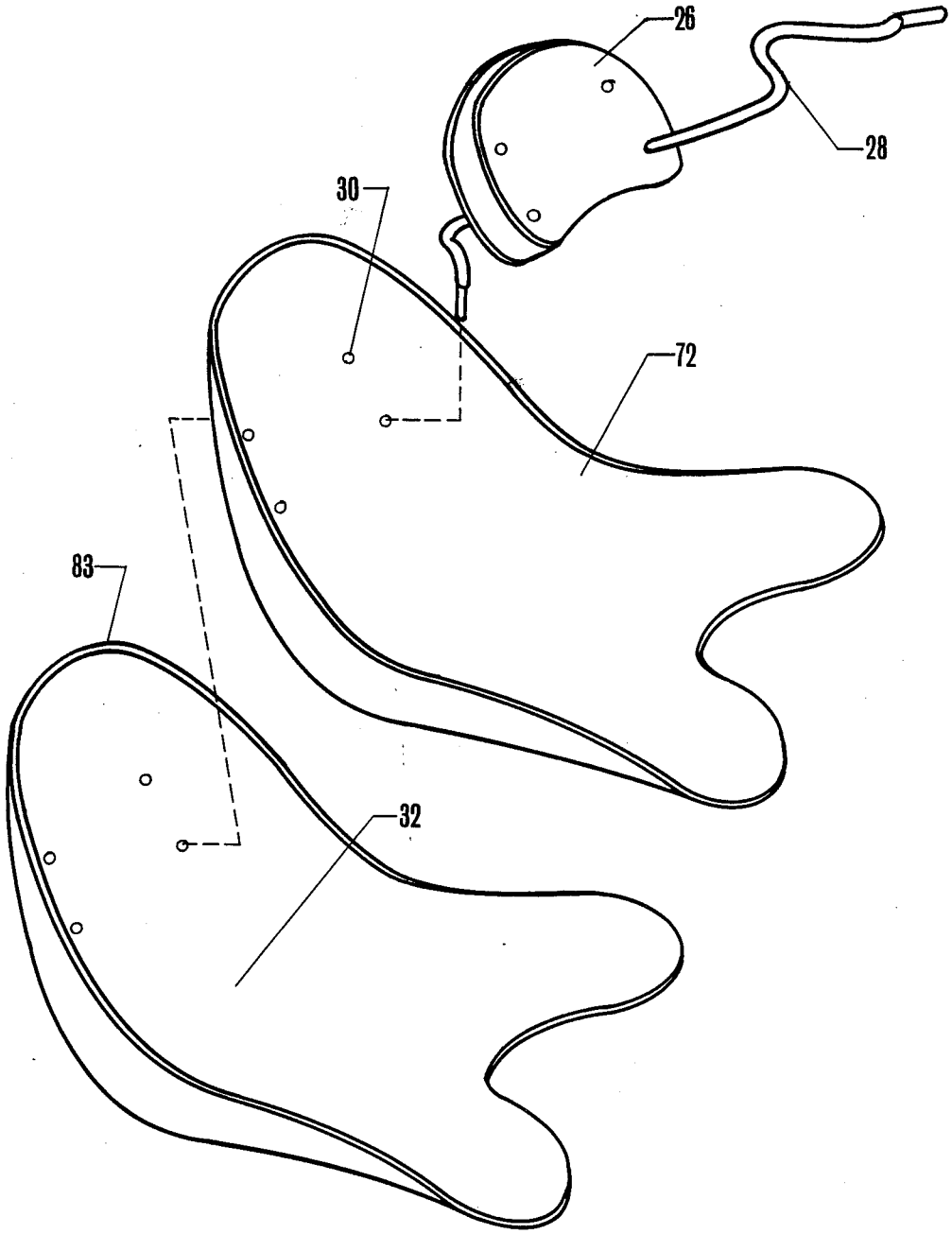
FIG. 3 an exploded view of the chair shell of FIG. 2, demonstrating the alternative back foam pad placement.
Figure 4:
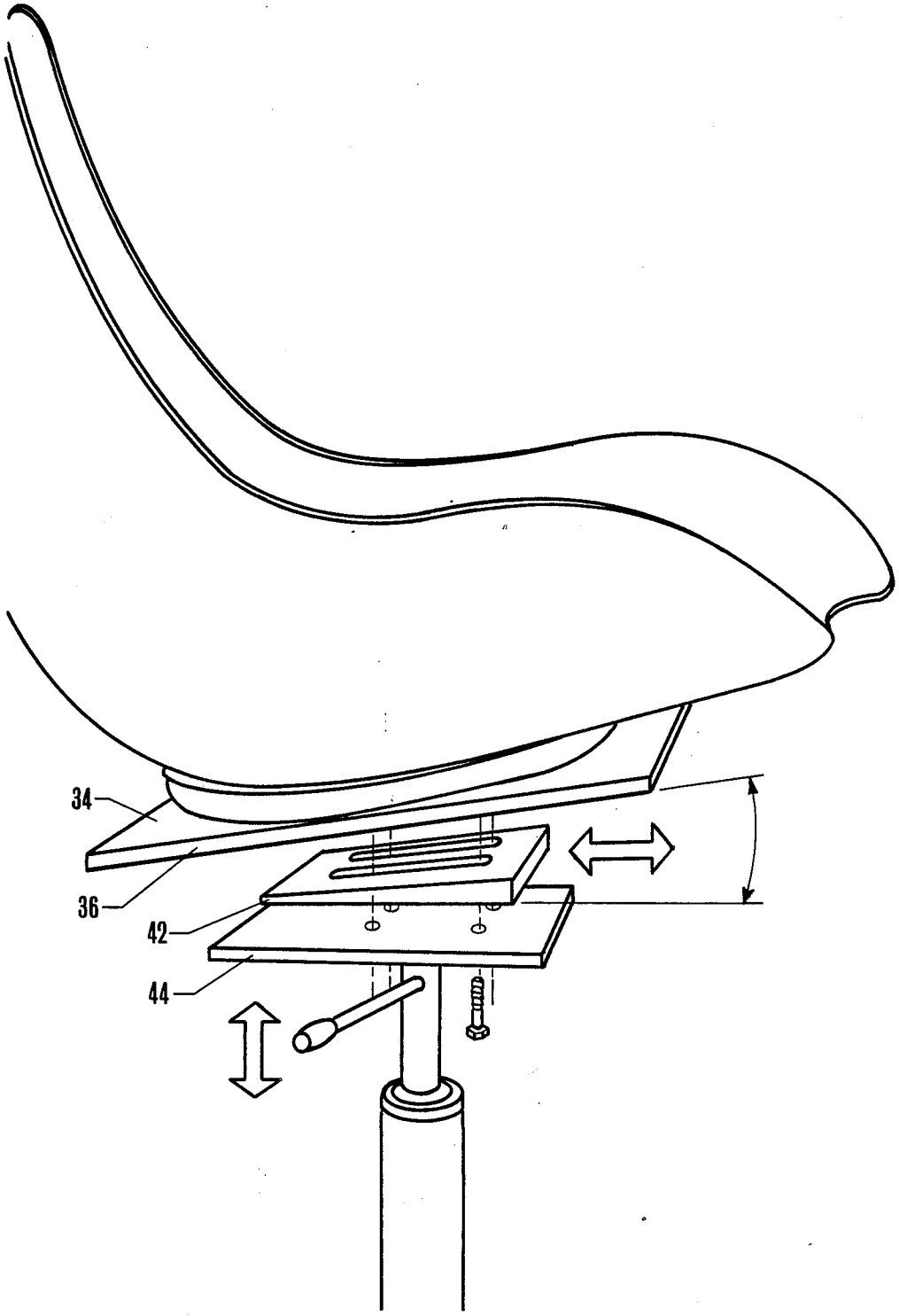
FIG. 4 an exploded view of the mounting ring base and chair stand mounting assembly, illustrating the chair mount wedge.

Sacroiliac relief 20, FIG. 3, within the chair shell is depicted. Foreward displacement of the subjects back and body away from the chair shell is also caused by the positioning of the lumbo thoracic compression cushion.

A strong positive body contact area is made in the lumbo thoracic area 24, FIG. 1. This contact is made totally upon the lumbo thoracic cushion 26, which may be custom mounted in any upper area of the chair back according to individual subject needs, or more generalized needs according to requirements. This cushion is made of foam rubber which is cut to desired thickness and also custom contoured if necessary.

FIG. 3 is an exploded view which shows the polypropylene chair shell 83, the inner liner, 72 made of an expanded, cross linked polyethylene material, and the lumbo thoracic compression cushion 26. The inner liner material of the present invention is slightly compressable under pressure and is quite durable and resilient. The material is also light weight and possesses the properties of good tensile strength and elongation.

During custom fitting of the chair for a specific individual, the lumbo thoracic cushion 26, can be positioned temporarily by string ties 28, which pass through the foam cushion and are tied through holes 30, drilled in the chair back. Later, when the proper position is determined, the foam cushion 26, can be cemented directly to the chair back lining material. The actual contours of the compressable material itself can also be altered for specific purposes. Once the pad position and pad contouring specifications have been determined, the entire chair surface is covered with a non skid surface material, such as leather, and the like.

Figure 5:
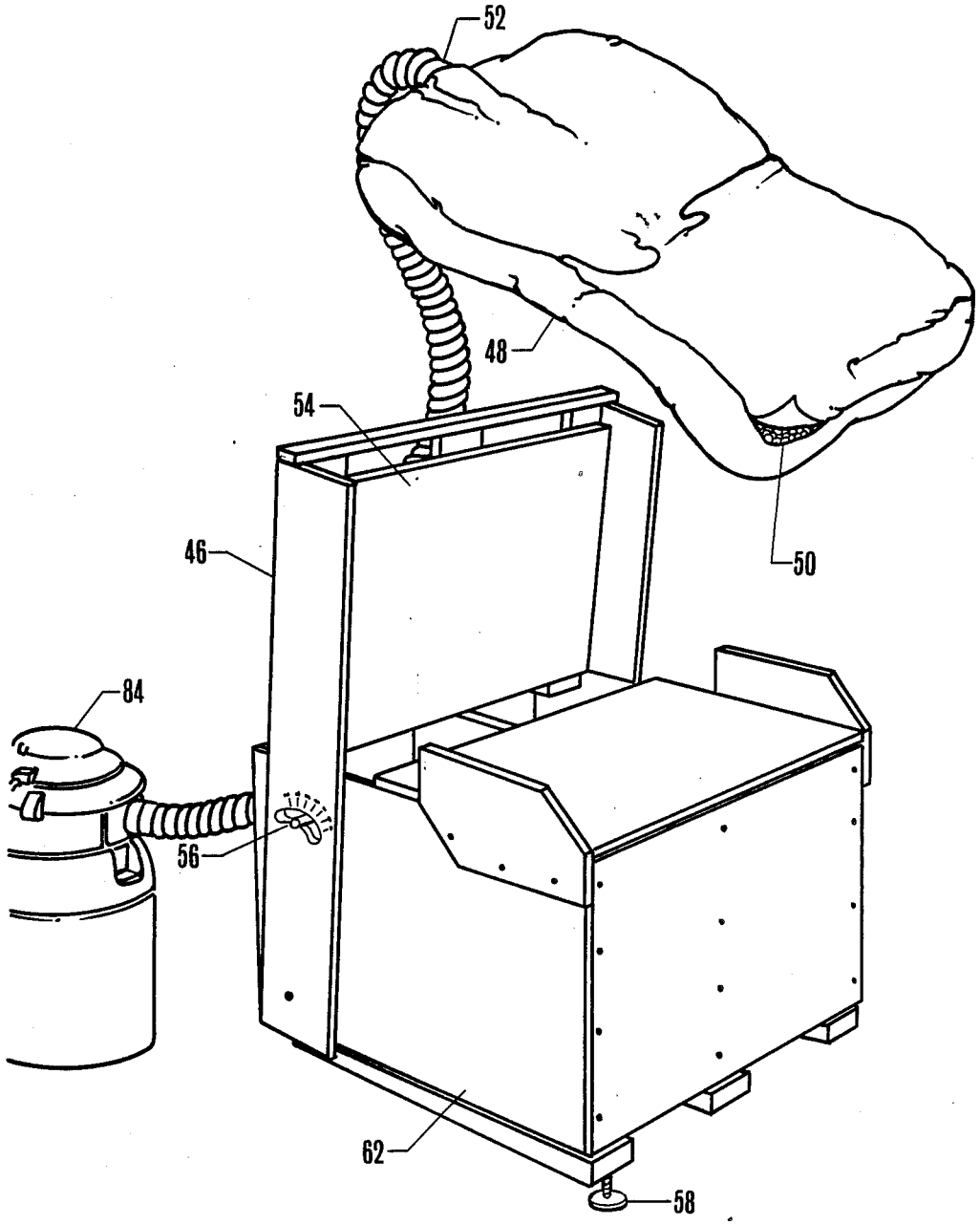
FIG. 5 depicts the impression support seat with the impression bag about to be placed upon it in the proper impression position.

FIG. 5 illustrates the angle with which the chair shell 83 is mounted to the adjustable chair stand 38. A slightly upward angle from the horizontal is important. This angulation, the non-skid surface of the chair lining, and the buttock, recto genital relief area 22, FIG. 2, described here in above, prevent the subject from creeping foreward and thus sliding into a slouched, or misalligned spinal position.

The chair shell mounting ring 34, is shown along with the mounting ring base, 36. These portions, 34 and 36, of the chair apparatus are both made of strong high impact material, such as polypropylene and are attached to the shell body by a polypropylene welding process. They are in turn mounted to an adjustable chair stand 38, which in the chair version portrayed, is attached to floor casters 40, FIG. 1. The degree of angulation of the mounting of the chair shell to the adjustable chair stand is sometimes critical and is regulated by the placement of a chair mount wedge 42, of a specific angulation. The wedge 42, is bolted between the mounting ring base 36, and the adjustable chair stand base support, 44.

Figure 6:
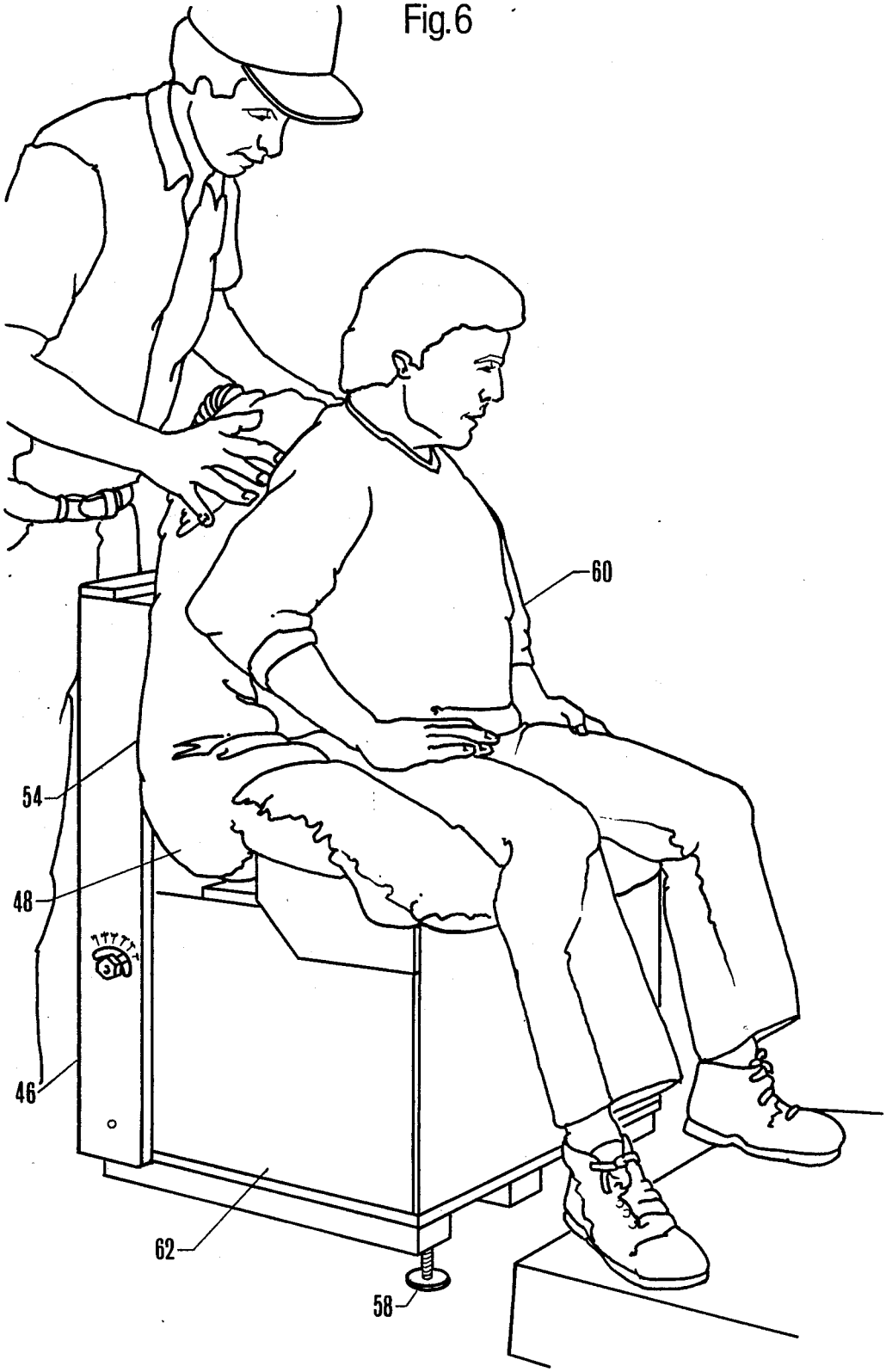
FIG. 6 illustrates a subject being fitted to form a negative mould within the impression bag, or bladder.

The preceeding description pretains to the features of the embodiments. The method for the fabrication of the invention will be outlined in the following paragraphs. Referring to FIG. 6, the impression technique for obtaining the chair shell 83, is initiated using a mold support bench 46, and an airtight flexible bladder 48. Bladder 48, can be made of any thin, (6 to 8 mils), polymer plastic or of any similar airtight and flexible material. Bladder 48, is loosely filled with small polystyrene foam spheres or pellets, 50, or other relatively light weight and non-compressible pellets. Sealed to the only opening in bladder 48, is a tube 52, leading to a vacuum source 84.

The back 54, of the support bench 46, is adjusted by the operator to the desired seating angle by rotating back 54 about pivot point 56, and securing it in position by appropriate means, shown schematically in FIG. 6. The height of the support may be adjusted to the height of the expected user or class of users through appropriate adjusting means by raising or lowering base 62, for example with adjustable screw legs, 58.

To initiate the impression taking process, bladder 48, is laid flat on the floor or other flat horizontal surface, and air is partially removed from the bladder by vacuum pump 84. With the air thus partially removed, the pellets are pressed tightly against one another and the flat configuration of the bladder tends to remain stable despite small disturbances in position and other forces. Referring to FIG. 6, the molding bladder 48, is bent in its mid-portion to form roughly a right angle. The bladder is placed on the support bench 46, while the air remains still partially removed. The vacuum force is then discontinued allowing air to re-enter the bladder 48, The bladder then expands to assume the contours and position of the support bench and is again filled only loosely, with the pellets 50, free to move around within the bladder.

Figure 7:
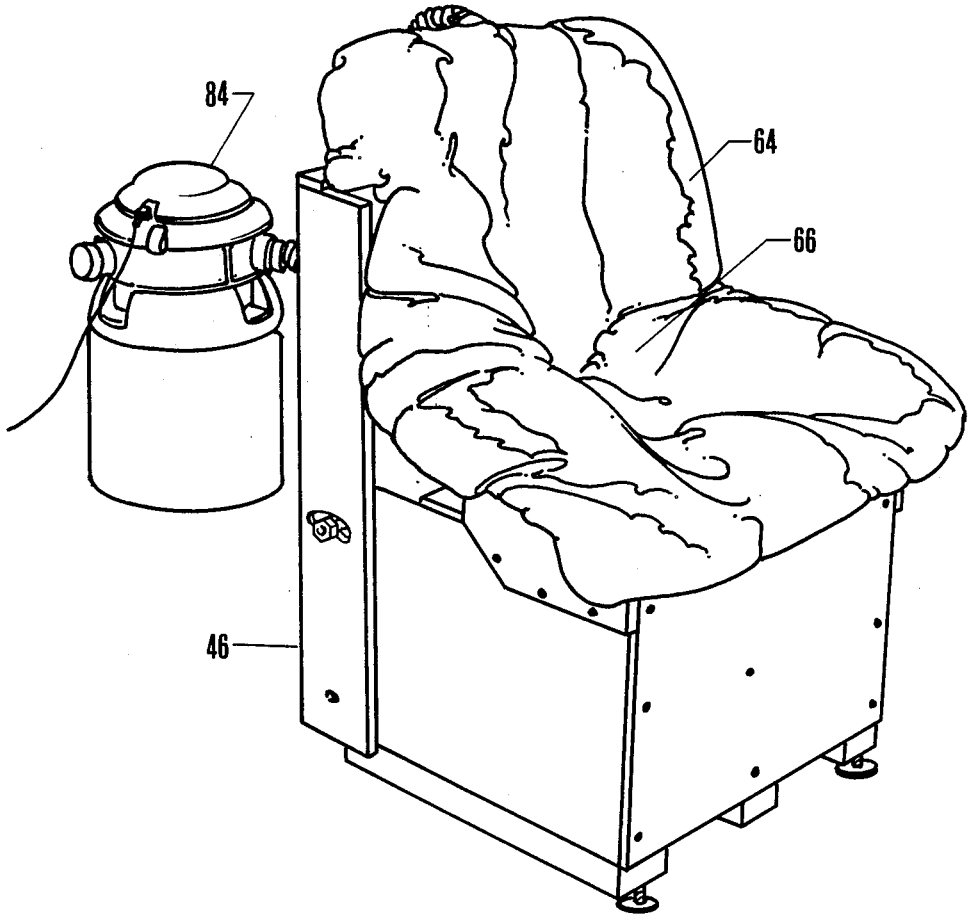
FIG. 7 is a perspective view illustrating the negative mould obtained by application of a vacuum force to the impression bladder.

FIG. 7 illustrates the next step in the process. Subject 60, assumes a sitting posture on the top of the loose now vacuum released bladder 48, The subject 60, can either be the exact individual for whom a chair is to be built or it can be a person of average shape and size within a target population for whom a mold for a set of standard chairs is to be made. Several molds may be taken for building a series of standard size chairs.

The subject is positioned comfortably on the mold support bench 46, and on the loose bladder 48. If necessary, the bench back 54, angle and the height of the base 62, can be re-adjusted at this point. Areas of the bladder that represent portions of the chair that will contact the user are checked and, if necessary, the bladder is shaped by pressing the pellets to move them into the desired position. The air is once again removed from the bladder 48, while the subject 60, remains seated in place. This causes the foam spheres within the bag to press against each other once more. As long as the vacuum is maintained, the pellets will remain in a stable shape even after the subject leaves the impression bag.

Figure 8:
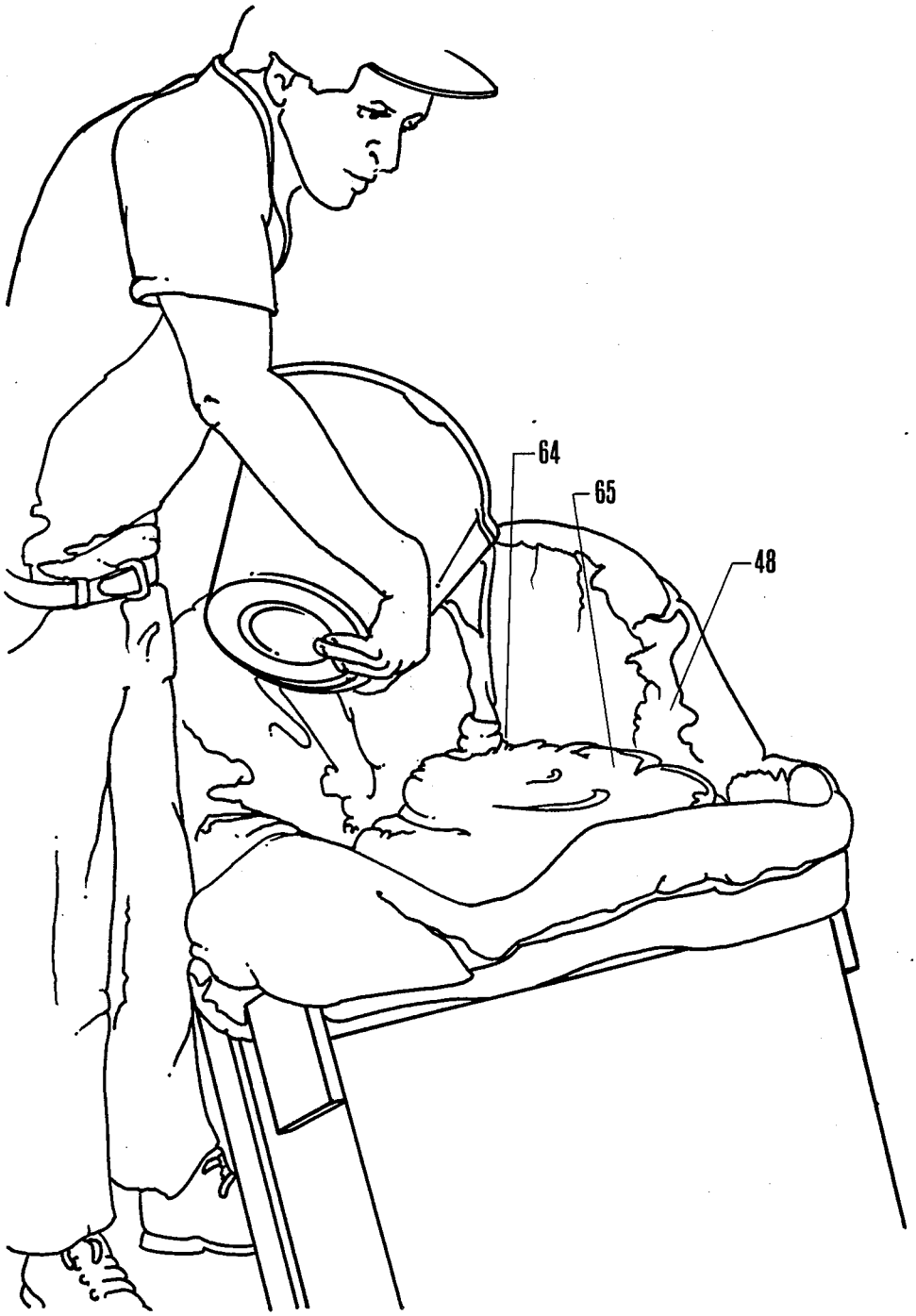
FIG. 8 the pouring of rapid set plaster into the vacuumed negative mold.
Figure 9:
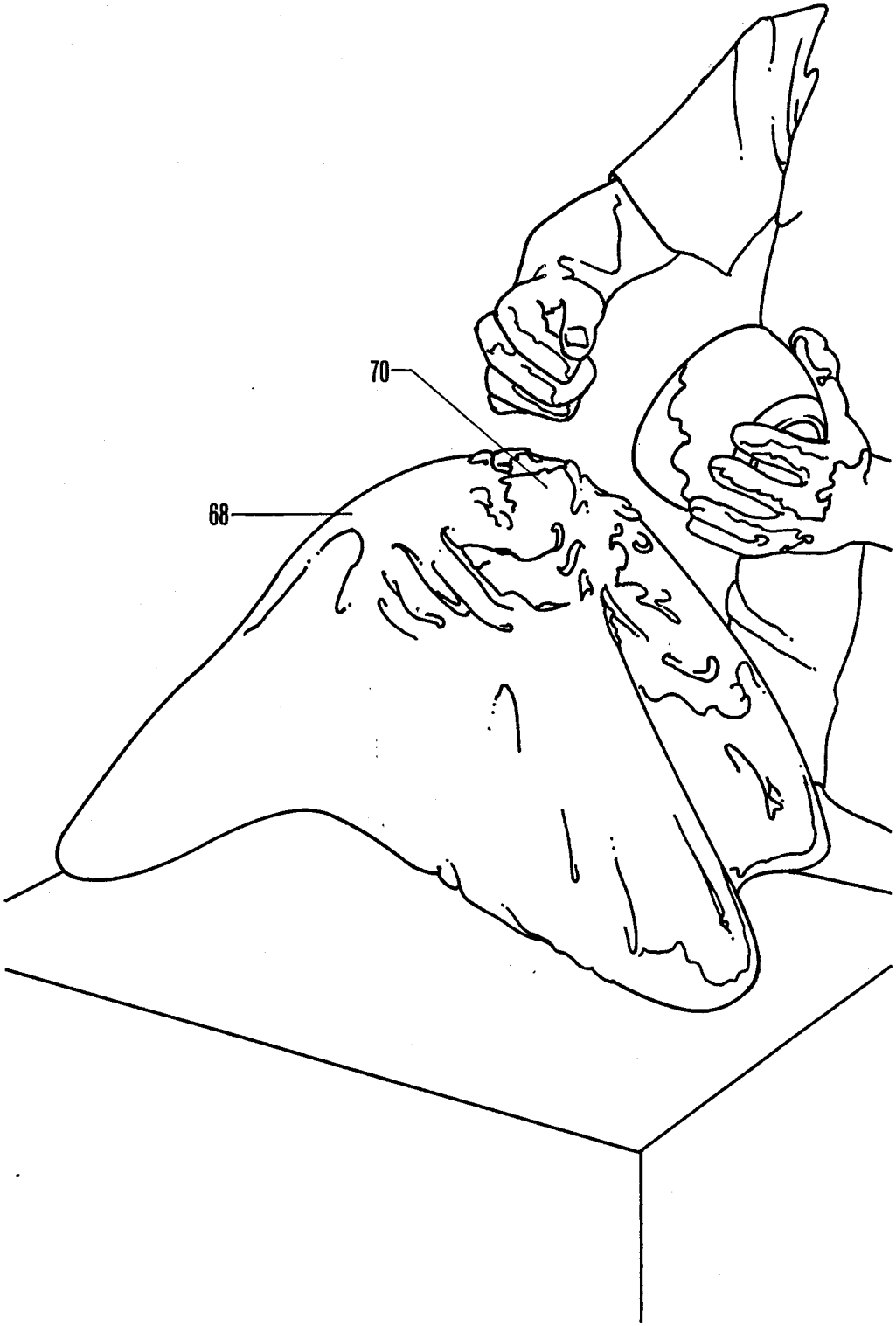
FIG. 9 illustrates the hands on addition of plaster to the needed relief areas of the newly formed positive plaster mold.

The result of the process thus far is to leave a negative impression 64, of the lower portion of the subject's body FIG. 8, Area 66. This in particular, is a true impression of the pelvic area and will have to be modified, as will be described later. No modification is made at this point however. Impression 64, is checked for such things as large creases caused by folds in the bladder or for other inaccuracies that may necesitate remolding the subject 60. If the mold is satisfactory, plaster of Paris material or other self hardening material or compound, is poured into the negative impression 64, FIG. 9, and allowed to harden. Note that the entire support bench may have to be tilted backwards in order to contain the plaster. The shape of the bladder is not disturbed as long as the vacuum is maintained.

Figure 10:
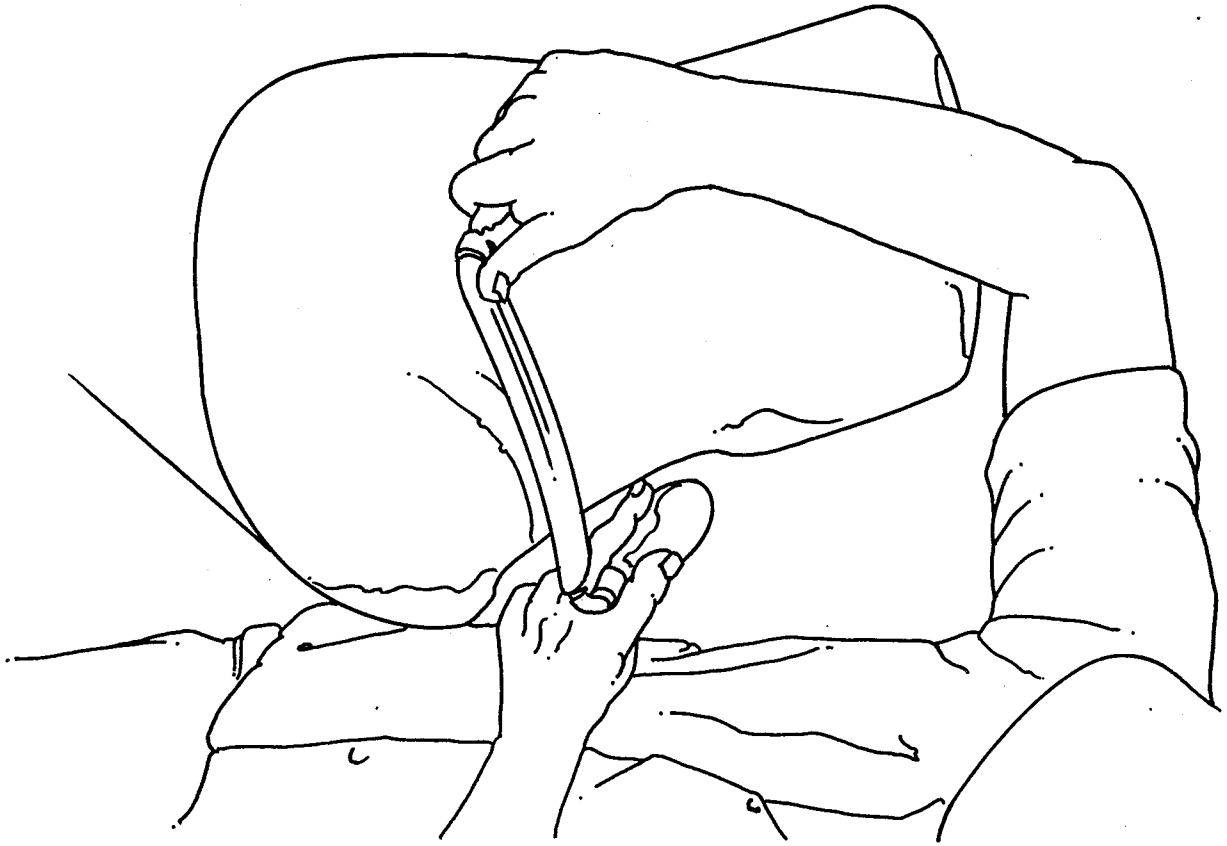
FIG. 10 the hand reduction of any excess areas of plaster which may need reduction or smoothing.

Once hardened, the plaster is removed from the bladder 48, resulting in a plaster positive mold 68, FIG. 10, of the bottom negative impression 64, representing the lower portion of the subject's chair contacting portion of the body.

Figure 11:
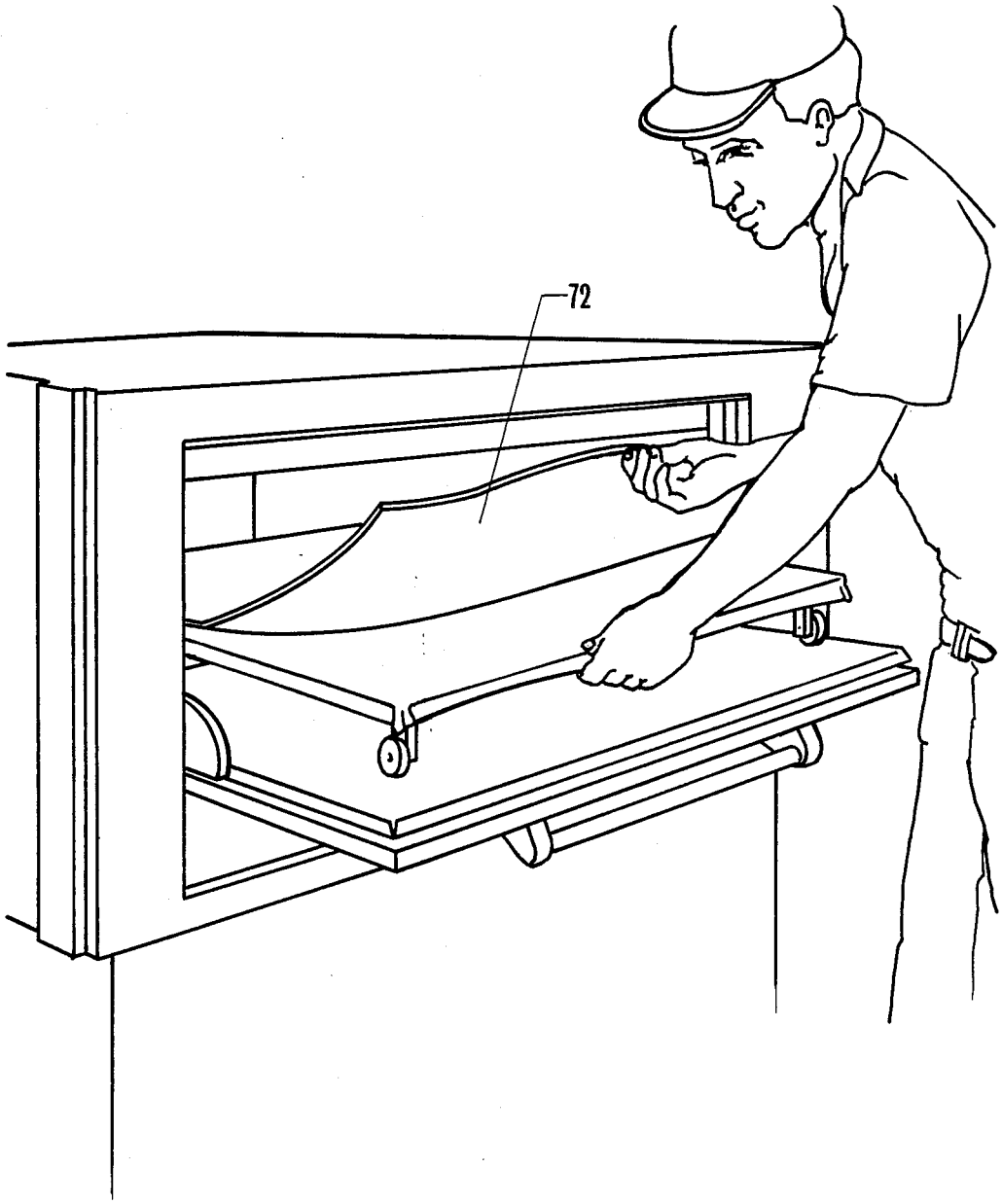
FIG. 11 shows the heating of plastic material used to fabricate the chair shell.

At this point, creases can be either filled with plaster, FIG. 10, or filed off, FIG. 11, as may be necessary. Other general mold imperfections can also be corrected by filing or filling. With respect particularly to the true pelvic positive mold 68, corresponding to the true pelvic negative impression area 66, FIG. 8, a plaster pelvic supplement 70, FIG. 10, must be added. This is because, if uncorrected, the resulting fit will put pressure on the coccyx bone structure, (tail bone), at the base of the spine. This pressure can result in discomfort or even nerve or muscular damage in this area. The entire ischio-rectal region of the perineum of the pelvis requires relief for the same reason. A ridge is otherwise left that is disturbing to a user, particularly to hemorrhoid sufferers. A built-up plaster pelvic supplement 70, is added to the positive mold 68, in the area corresponding to the true pelvic image 66. As mentioned previously, other areas of stress relief can be devised in this manner to suit health or comfort problems.

Figure 12:
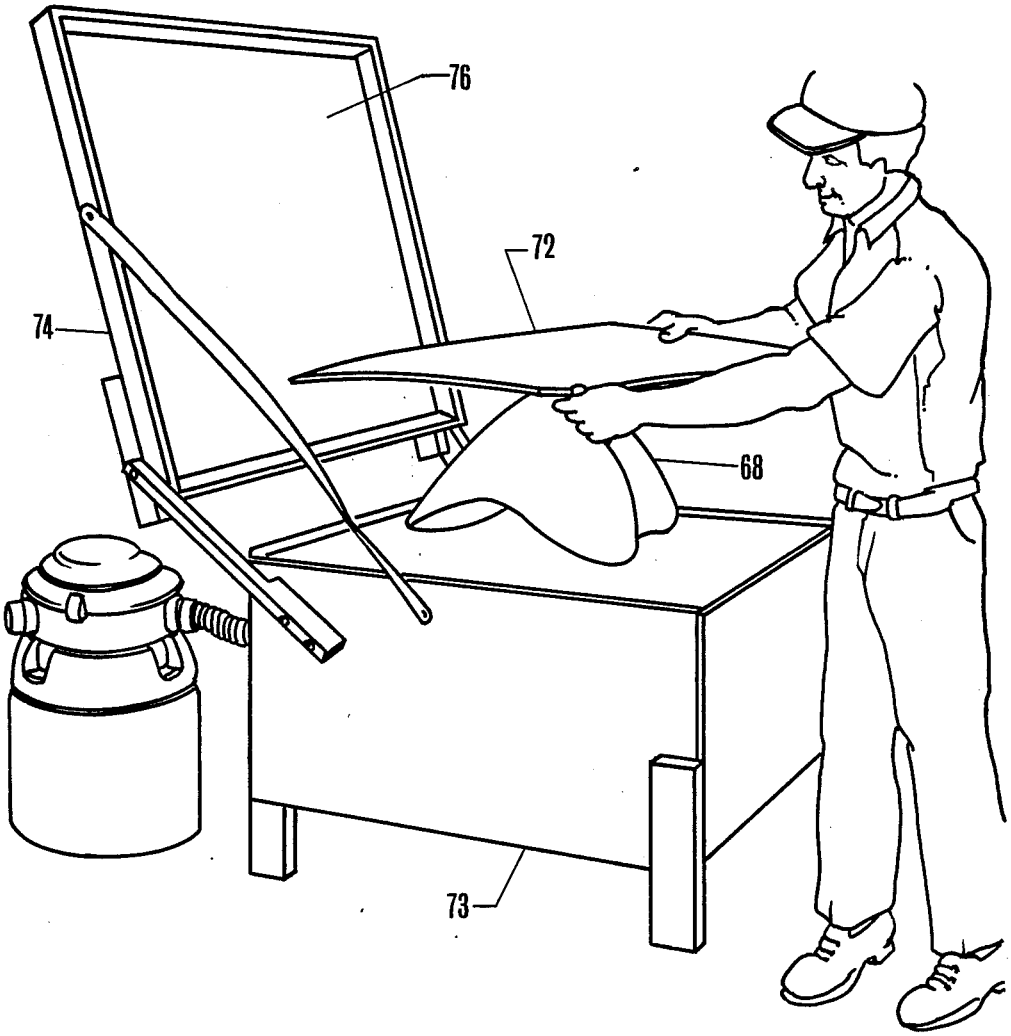
FIG. 12 is a view of the plaster positive mold on the vacuform apparatus with a sheet of heated plastic material about to be vacuum formed.

FIG. 12 illustrates the heating of the first layer of moldable thermoplastic material which is to be vacuformed over over the positive plaster mold 68. The first layer of plastic material to be applied to the mold is the expanded crosslinked polyethylene material of ⅛ in. thickness.

Figure 13:
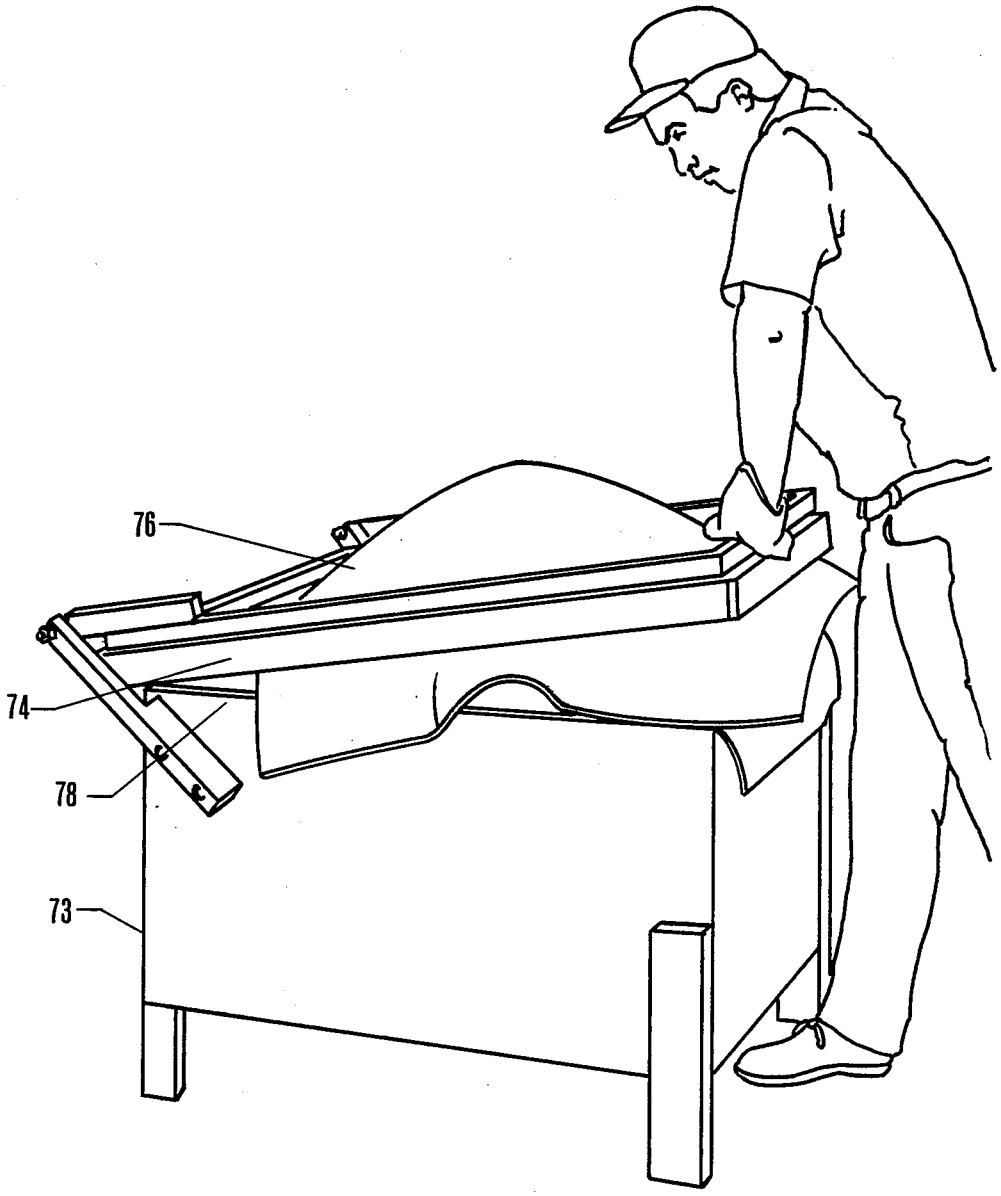
FIG. 13 shows the vacuum adaptation process being performed.

This thermoplastic material is heated to a temperature range of between 250 degrees to 350 degrees Fahrenheit for a time period of about 10 to 15 minutes until the material becomes pliable. It is then transferred to the vacuform adaptation apparatus and placed over the positive plaster mold, 68 as shown in FIG. 13. It should be be noted that an intermediate layer of nylon rib stockinette material is interposed between the first layer and the positive plaster mold to prevent any adherance of the first layer to the positive plaster mould and to act as an insulating layer.

Once the heated sheet of the first layer 72, is in position and roughly conforms in shape to that of the positive mold 68, vacuum frame 74, containing an airtight rubber bladder 76, is lowered over the image positive mold 68, and affixed to the stand 78. Air is pumped out of the interior of the chamber formed by bladder 76 through line 82 leading to vacuum source 84. This forces the first layer 72, into an exact position on the positive mold 68, where it is allowed to cool and thus remain as a permanent negative image of the support surfaces of the subject 60, with the exception of the areas corresponding to previously mentioned relief supplement locations. Hence, these supplement areas do not contact, or contact only lightly, the eventual user of the finished chair. The vacuum bladder 76, is then removed.

The next steps are similar to those utilized in connection with the adaptation of the first layer, and are not separately illustrated. The thin, temporary, insulating layer of nylon rib knit stockinette is now placed over the top of the molded first layer 72. This, in turn, prevents overheating of the first layer during the similiar vacuum adaption of the second layer of polypropylene shell material during the vacuum formation process.

Figure 14:
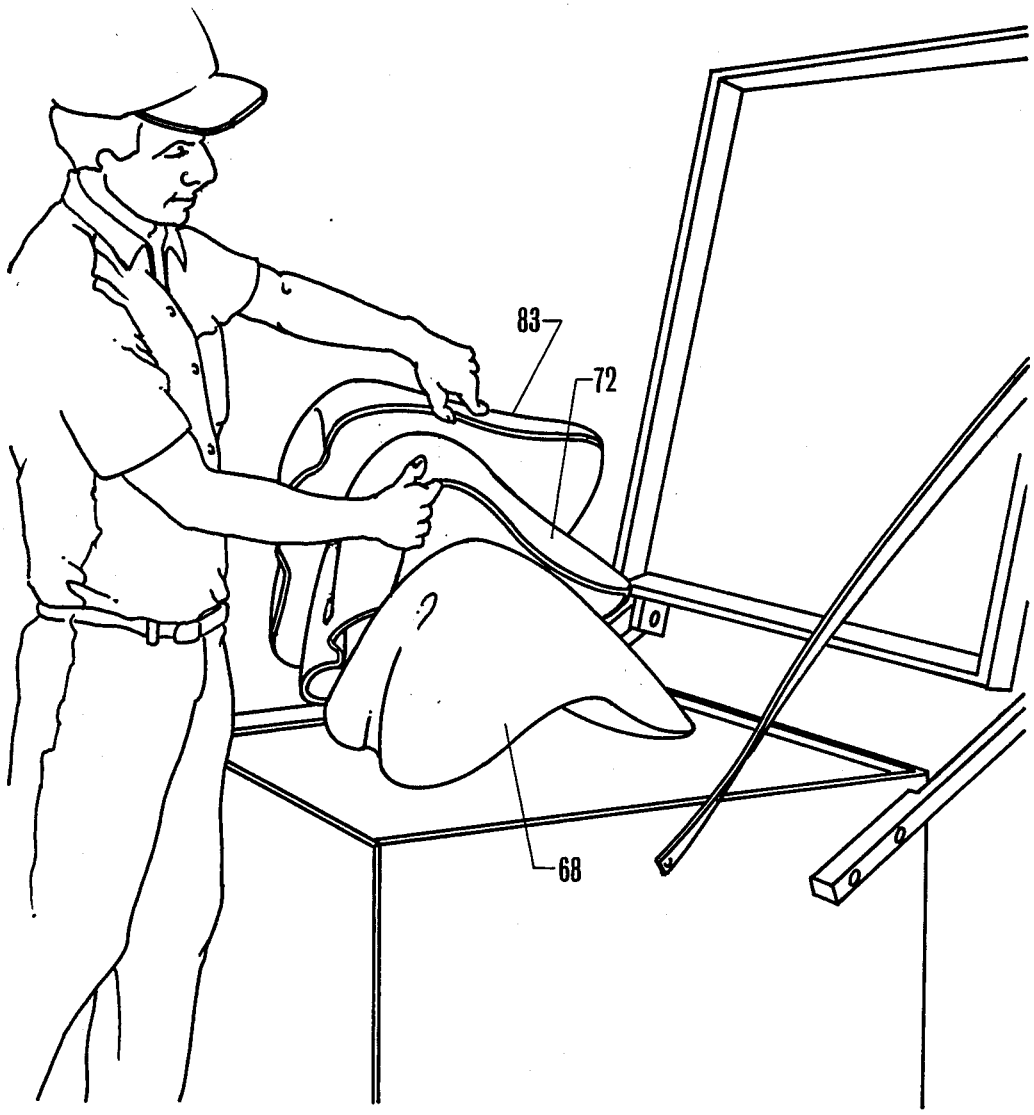
FIG. 14 illustrates the newly formed sheets of both Pe-Lite and Polypropylene being removed from the positive plaster mold.

A sheet of polypropylene or rigid thermoplastic is heated to a temperature of about 350 to 375 degrees Fahrenheit for a period 8 to 10 minutes in an oven. It is preferred to use 3/16" or ⅛" stress relieved polypropylene. Since this rigid thermoplastic sheet will be heated to a greater extent than the the first layer 72, it is installed in a support frame to prevent its distortion while heating. When sufficiently softened, the polypropylene is removed from the oven and placed directly over the stockinette covering the first layer, which in turn covers the plaster positive mold 70. Bladder 76 in frame 74 is again lowered over the entire positive image 68, including covering the first and second layers. Air is again removed by pump 84. This causes the second layer to conform to the curvature of the positive mold as with the first molding process. See FIG. 14.

When the polypropylene has cooled sufficiently, the vacuum frame 74 and the polypropylene stretcher frame (not illustrated) are removed.

Referring now to FIG. 15, it can be seen that the polypropylene has formed a rigid support shell 83 and the first layer of cross linked polyethylene material has formed a separate cushioned liner 72. The two shells 83 and 72 are removed from the mold 68 and are separated. The insulating stockinette is removed and the shells 83 and 72 are trimmed to the desired peripheral shape and inspected for warpage or other defects.

In particular, area 90, FIG. 2 is cut away from the shells in order that the chair not contact significantly the inside of the user's thighs. Seat portion 92 of the chair shell 83 thus terminates in two thigh support flanges 94.

The recto genital relief area 22, shown shaded in FIG. 2 again was created by the addition of the pelvic supplement material 70 before vacuum molding. It is located at the curved intersection of the back rest portion 96 and the seat portion 92.

Also illustrated by appropriate shading is the concavity 20 left naturally by the impression of the subject's spine. Concavity 20 can be modified for stress relief in the same manner as done in the case of the pelvic relief concavity 22, if desired. The liner 72 is permanently affixed to the support shell 88 by means of contact cement.

It should be noted, that the concept of the chair should not be limited soley to the mounting upon an adjustable stand. The comprehensive chair shell may also be adapted for use in many various situations such as use in autos or airplanes or in any situation where good posture and proper prolonged alignment are important to the user. The design and technique are flexible and again can be customized for a multitude of purposes.

While one embodiment of the present invention has been described and shown, it will be obvious and clear to those skilled in the art to which the invention pretains, that changes and modifications may be made within the scope of the present invention. Therefore, it is the aim of the ammended claims to cover all such changes and modifications as within the true and full spirit and scope of the invention.

What is claimed is:

1. A chair for prolonged body support formed from contoured specifications comprising a one positive molded substantially vertical back having a positive contact area in the lumbo thoracic area; and having substantially horizontal seat support shell having an upper area of the chair back and having relief areas in the sacroliac and recto genital areas and concave areas in the spinal area another areas as needed in one or more positive contact areas and one or more concave areas; said shell is mounted on a mounting ring base, said base then securely affixed to said mounting, then movably affixed to a mounting wedge interposed between the shell and a chair stand; said mounting ring base and mounting wedge adjustably mounted to said chair stand base support.

2. A chair as claimed in claim 1 comprising an individual custom molded contoured one piece seating receptacle mounted on a mounting ring and affixed to a chair stand base support; said seating receptacle having a substantially vertical upper back area, a substantially horizontal seat support, one or more positive contact areas and one or more concave areas defined by the custom contour specificiations produced by the body to occupy said chair;

at least one positive contact area in the lumbo thoracic area; said molded contoured one piece seating receptacle a lamination of a molded inner liner of non-compacting thermo formable foamed resin, an outer shell of molded high impact thermo formable material with adhesive material interposed therebetween;

relief areas in the sacroiliac and recto genital areas and at least one of said concave areas in the spiral area, and wherein said laminated one piece seating receptable is mounted on a mounting wedge interposed between the seating receptacle and said chair stand base support.

3. The chair of claim 1 wherein said positive molded back and seat support have a positive contact area in the lumbo thoracic area.

4. The chair of claim 3 wherein said positive contact area in the lumbo thoracic area is a foam cushion mounted in said upper area of the chair back.

5. The chair of claim 1 comprising a laminated one piece positive molded back and seat support, said lamination comprising an inner liner, a rigid outer support shell and an adhesive material interposed therebetween.

6. The chair of claim 5 wherein said inner liner is a non-compacting thermo formable foamed resin and said outer shell is a high impact material.

7. The chair of claim 6 wherein said inner liner is covered with a non-skid surface material.

8. The chair of claim 1 having relief areas in the sacroiliac and recto genital areas and concave areas in the spinal area and other areas needed and formed in molding as needed by the contoured specifications.

9. The chair of claim 1 having a thermoplastic shell with a molded substantially horizontal seat and a substantially vertical molded support having a slightly less than 90 degrees angulation with respect to said horizontal seat which can thereby be caused to move to follow the user by applying thrust on the weight bearing areas of the lowest thighs.

10. The chair of claim 9 in which said back support can be caused to move forward by applying thrust toward the back when desired by the seated user by tensing stomach muscles and placing thrust in the weight bearing area of the lower thigh.

11. The chair of claim 9 having a following back support controlled by applying thrust to the molded seat by the seated user.

* * * * *